US010619227B2

(12) United States Patent
Lee

(10) Patent No.: US 10,619,227 B2
(45) Date of Patent: Apr. 14, 2020

(54) THIN FILM RESISTOR

(71) Applicant: Ying-Chieh Lee, Kaohsiung (TW)

(72) Inventor: Ying-Chieh Lee, Kaohsiung (TW)

( * ) Notice: Subject to any disclaimer, the term of this patent is extended or adjusted under 35 U.S.C. 154(b) by 101 days.

(21) Appl. No.: 16/048,836

(22) Filed: Jul. 30, 2018

(65) Prior Publication Data

US 2019/0226057 A1 Jul. 25, 2019

(30) Foreign Application Priority Data

Jan. 22, 2018 (TW) ..... 107102222 A

(51) Int. Cl.
*C22C 19/05* (2006.01)
*H01C 7/00* (2006.01)
*C22C 30/00* (2006.01)

(52) U.S. Cl.
CPC ..... *C22C 19/05* (2013.01); *C22C 30/00* (2013.01); *H01C 7/006* (2013.01)

(58) Field of Classification Search
CPC ..... C22C 19/055; C22C 19/053; C22C 30/00; H01C 7/00
See application file for complete search history.

(56) References Cited

PUBLICATIONS

Wang, Jiangtao, and Sid Clouser. "Thin film embedded resistors." Proc. IPC Expo. 2001.*

* cited by examiner

*Primary Examiner* — Jessee R Roe
(74) *Attorney, Agent, or Firm* — WPAT, PC

(57) ABSTRACT

A thin film resistor has a higher resistivity compared to that of a conventional thin film resistor. The thin film resistor includes 30-45 at % of nickel, 15-30 at % of chromium, 1-10 at % of manganese, 10-30 at % of yttrium and 1-20 at % of tantalum.

4 Claims, 1 Drawing Sheet

THIN FILM RESISTOR

CROSS REFERENCE TO RELATED APPLICATIONS

The application claims the benefit of Taiwan application serial No. 107102222, filed Jan. 22, 2018, the entire contents of which are incorporated herein by reference.

BACKGROUND OF THE INVENTION

1. Field of the Invention

The present invention generally relates to a resistor and, more particularly, to a thin film resistor.

2. Description of the Related Art

Resistors are a type of passive components and can be classified into two types, one of which is a thick film resistor, and the other one is a thin film resistor. Thick film resistor is generally used in consumer electronics having lower requirements in the accuracy and tolerance of resistance. Thin film resistor has relatively high accuracy along with improvement in the preparation methods and materials and can, thus, be used in delicate instruments, such as medical instruments, industrial computers, and automobiles, thereby having a high economic potential.

The ingredients of a thin film resistor are generally the decisive factor of the applications, and the temperature coefficient of resistance (TCR) and the resistivity of the thin film resistor are especially the indexes of the applications. An excellent thin film resistor should have a low TCR, such that when the thin film resistor is assembled to form a chip resistor or an electronic device, the volume can be reduced while having high operating stability.

A conventional thin film resistor including chromium (Cr), manganese (Mn), yttrium (Y) and nickel (Ni) is disclosed in Taiwan patent publication No. 201643262. The conventional thin film resistor has a low TCR in the range of +25 ppm/° C. to −25 ppm/° C. such that the conventional thin film resistor maintains excellent stability even after a temperature change. However, a resistivity of the conventional thin film resistor is slightly marred. In light of this, a need exists for a novel thin film resistor to solve the problems resulting from the failure of reaching a high resistivity with a low TCR at the same time.

SUMMARY OF THE INVENTION

It is therefore an objective of the present invention to provide an thin film resistor reaching a high resistivity with a lower TCR compared to the conventional thin film resistor at the same time.

One embodiment of the present invention discloses a thin film resistor including 30-45 at % of nickel (Ni), 15-30 at % of chromium (Cr), 1-10 at % of manganese (Mn), 10-30 at % of yttrium (Y) and 1-20 at % of tantalum (Ta). Preferably, the film resistor includes 42.9-43.8 at % of Ni, 19.9-20.7 at % of Cr, 4.7-5.6 at % of Mn, 24.8-25.6 at % of Y and 4.3-7.7 at % of Ta. Accordingly, due to the ingredients (Ni, Cr, Mn, Y and Ta) and the specific ratio (30-45 at % of Ni, 15-30 at % of Cr, 1-10 at % of Mn, 10-30 at % of Y and 1-20 at % of Ta), the thin film resistor can have not only a low TCR (in the range of +25 ppm/° C. to −25 ppm/° C.), but also a higher resistivity compared to the conventional thin film resistor.

In an example, sum of atomic percentages of Ni and Ta is larger than 45 at %. Alternatively, sum of atomic percentages of Y and Ta is larger than 30 at %. As such, the thin film resistor can have not only enhanced resistivity, but also decreased TCR near zero.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
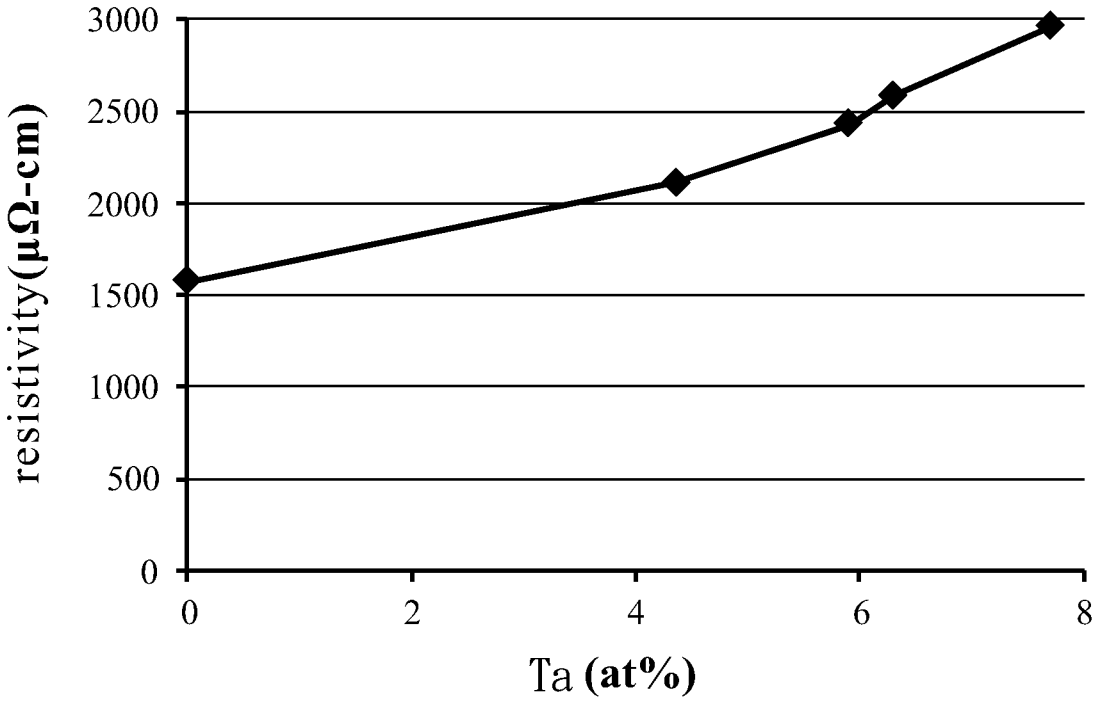
FIG. 1 depicts a line chart illustrating the relationship between the resistivity and tantalum (Ta) content of the thin film resistors of groups A0-A4.

In the various figures of the drawings, the same numerals designate the same or similar parts. Furthermore, when the term "first", "second" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

A thin film resistor according to an embodiment of the present invention can include nickel (Ni), chromium (Cr), manganese (Mn), yttrium (Y) and tantalum (Ta). As an example, the thin film resistor can include 30-45 at % of Ni, 15-30 at % of Cr, 1-10 at % of Mn, 10-30 at % of Y and 1-20 at % of Ta. Preferably, the thin film resistor includes 42.9-43.8 at % of Ni, 19.9-20.7 at % of Cr, 4.7-5.6 at % of Mn, 24.8-25.6 at % of Y and 4.3-7.7 at % of Ta. Moreover, the sum of atomic percentages of Ni and Ta is larger than 45 at %. Alternatively, the sum of atomic percentages of Y and Ta is larger than 30 at %. With such performance, the thin film resistor has not only the increased resistivity, but also the temperature coefficient of resistance (TCR) near zero.

The thin film resistor can be produced by any conventional method for producing thin film resistors, such as vacuum evaporation or sputtering. In this embodiment, D.C. magnetron sputtering is used, metal meeting the composition of the thin film resistor is used as the target, and sputtering is conducted in a vacuum by using a D.C. current with a fixed power which can be set at 70 W. After sputtering, annealing is conducted for 4 hours at 300° C. Thus, a thin film resistor of a thickness smaller than 300 nm is deposited on a substrate. The thickness of the thin film can be adjusted according to the time and power of sputtering, which can be appreciated by a person having ordinary skill in the art, and therefore is not limited in the present invention.

Accordingly, due to the ingredients (Ni, Cr, Mn, Y and Ta) and the specific ratio (30-45 at % of Ni, 15-30 at % of Cr, 1-10 at % of Mn, 10-30 at % of Y and 1-20 at % of Ta), the thin film resistor can have not only a low TCR in the range of +25 ppm/° C. to −25 ppm/° C., but also a significant higher resistivity compared to the conventional thin film resistor.

To evaluate the thin film resistor according to the present invention has the low TCR and the high resistivity, the resistivity and the TCR at 25° C. of the thin film resistors of groups A1-A4 shown in TABLE are measured. The thin film resistor without tantalum (Ta), the conventional thin film resistor, is used as the thin film resistor of group A0.

TABLE 1

| Groups | Ni (at %) | Cr (at %) | Mn (at %) | Y (at %) | Ta (at %) |
|---|---|---|---|---|---|
| A0 | 44.9 | 21.8 | 6.6 | 26.7 | 0 |
| A1 | 42.9 | 19.9 | 4.7 | 24.8 | 7.7 |
| A2 | 43.3 | 20.2 | 5.1 | 25.1 | 6.3 |
| A3 | 43.4 | 20.3 | 5.2 | 25.2 | 5.9 |
| A4 | 43.8 | 20.7 | 5.6 | 25.6 | 4.3 |

Referring to FIG. 1, the thin film resistors of groups A0-A4 have the resistivity of 1580, 2966, 2589, 2433 and 2117 μΩ-cm, respectively. That is, the thin film resistors of groups A1-A4 have the resistivity higher than the thin film resistor of group A0, indicating the thin film resistor according to the present invention has the resistivity higher than the conventional thin film resistor. Moreover, the atomic percentage of Ta increases (from 4.3 at % to 7.7 at %), the resistivity of the thin film resistor increases.

Figure 2:
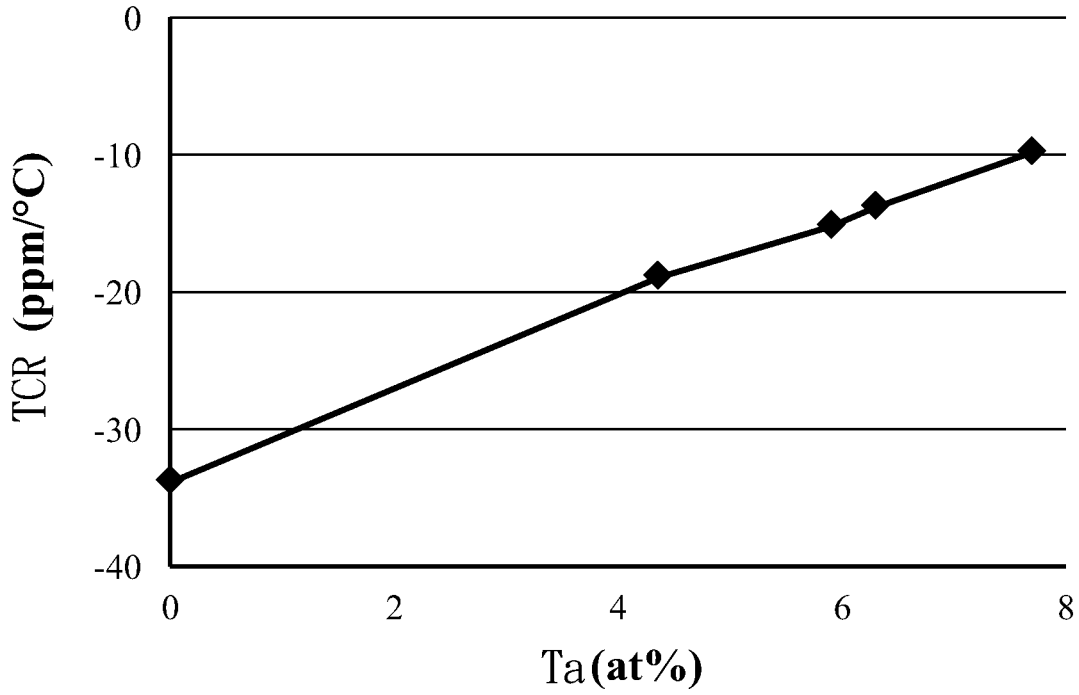
FIG. 2 depicts a line chart illustrating the relationship between the temperature coefficient of resistance (TCR) and tantalum (Ta) content of the thin film resistors of groups A0-A4.

In addition, referring to FIG. 2, the thin film resistors of groups A0-A4 have the TCR of −33.77, −9.65, −13.66, −15.08 and −18.75 ppm/° C., respectively. That is, the thin film resistors of groups A1-A4 have the TCR in the range of +25 ppm/° C. to −25 ppm/° C., indicating under the condition of the low TCR, the thin film resistor according to the present invention has the significant higher resistivity compared to the conventional thin film resistor.

Accordingly, due to the ingredients (Ni, Cr, Mn, Y and Ta) and the specific ratio (30-45 at % of Ni, 15-30 at % of Cr, 1-10 at % of Mn, 10-30 at % of Y and 1-20 at % of Ta), the thin film resistor can have not only a low TCR in the range of +25 ppm/° C. to −25 ppm/° C., but also a significant higher resistivity compared to the conventional thin film resistor.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A thin film resistor comprising 30-45 at % of nickel, 15-30 at % of chromium, 1-10 at % of manganese, 10-30 at % of yttrium and 1-20 at % of tantalum.

2. The thin film resistor as claimed in claim 1, wherein the thin film resistor comprises 42.9-43.8 at % of nickel, 19.9-20.7 at % of chromium, 4.7-5.6 at % of manganese, 24.8-25.6 at % of yttrium and 4.3-7.7 at % of tantalum.

3. The thin film resistor as claimed in claim 1, wherein sum of atomic percentages of Ni and Ta is larger than 45 at %.

4. The thin film resistor as claimed in claim 1, wherein sum of atomic percentages of Y and Ta is larger than 30 at %.

* * * * *